US012077919B2

(12) United States Patent
Volterrani et al.

(10) Patent No.: US 12,077,919 B2
(45) Date of Patent: Sep. 3, 2024

(54) INFILL FOR SYNTHETIC AND HYBRID TURFS AND TURFS SO OBTAINED

(71) Applicants: MAR.PROJECT S.R.L., Pisa (IT); Marco Volterrani, San Giuliano Terme (IT)

(72) Inventors: Marco Volterrani, San Giuliano Terme (IT); Martina Nusca, Pisa (IT)

(73) Assignees: MAR.PPROJECT S.R.L., Pisa (IT); MARCO VOLTERRANI, San Giuliano Terme (IT)

( * ) Notice: Subject to any disclaimer, the term of this patent is extended or adjusted under 35 U.S.C. 154(b) by 28 days.

(21) Appl. No.: 17/038,374

(22) Filed: Sep. 30, 2020

(65) Prior Publication Data

US 2021/0010209 A1 Jan. 14, 2021

Related U.S. Application Data

(62) Division of application No. 14/431,381, filed as application No. PCT/IB2013/058841 on Sep. 25, 2013, now Pat. No. 10,822,751.

(30) Foreign Application Priority Data

Sep. 28, 2012 (IT) ..... PI2012A000099

(51) Int. Cl.
*E01C 13/08* (2006.01)

(52) U.S. Cl.
CPC ..... *E01C 13/08* (2013.01); *E01C 2013/086* (2013.01); *Y10T 428/23921* (2015.04); *Y10T 428/31978* (2015.04)

(58) Field of Classification Search
CPC ..... E01C 13/08; E01C 2013/086; Y10T 428/31978; Y10T 428/23921
See application file for complete search history.

(56) References Cited

U.S. PATENT DOCUMENTS 5,282,873 A * 2/1994 Watari ..... E01C 13/08 47/1.01 R

FOREIGN PATENT DOCUMENTS

WO WO-2011051744 A1 * 5/2011 ..... E01C 13/08

* cited by examiner

*Primary Examiner* — Cheryl Juska
(74) *Attorney, Agent, or Firm* — LADAS & PARRY LLP; Malcolm J. MacDonald, Esq.

(57) ABSTRACT

A synthetic turf having a mat with a face arranged adjacent to a surface to coat, and a face opposite the face. The turf includes a plurality of blades made of a synthetic material that are connected to the mat. Above the face of the mat, an infill material is provided that is arranged among the blades. The infill material includes a predetermined percentage by volume of a vegetable material consisting of rachis of cereal ear. The infill material also includes a predetermined percentage by volume of a ligninic and/or resinous material of vegetable origin.

9 Claims, 5 Drawing Sheets

INFILL FOR SYNTHETIC AND HYBRID TURFS AND TURFS SO OBTAINED

This is a divisional application of U.S. application Ser. No. 14/431,381, filed Mar. 26, 2015, which is a 371 of International Application No. PCT/IB2013/058841, filed Sep. 25, 2013, which claims priority to Italian Patent Application No. PI2012A000099, filed Sep. 28, 2012.

FIELD OF THE INVENTION

The present invention relates to an infill material for synthetic turfs and "hybrid" synthetic-natural turfs based on organic material of vegetable origin, as well as to turfs thus obtained.

BACKGROUND OF THE INVENTION

As well known, a synthetic turf essentially consists of a mat made of plastic material to which blades of synthetic material are connected in order to simulate a natural turf. The blades of synthetic material are knitted to the mat by means of known processes, in order to provide rows of blades, which are close to each other according to the needs. All around the blades of synthetic material a loose material is usually distributed, usually called infill, for example a layer of sand followed by a layer of granular synthetic, or natural, material or a mixture thereof.

According to the kind of sports, for example soccer, hockey, cricket, rugby, etc., and of the destination of the synthetic turf, a suitable type of infill material is chosen (see for example Italian patent applications No. PI2001A000049 and PI2003A000036, in the name of the same applicant).

In particular, the infill material provides a draining action by adjusting the drainage of rainwater or of irrigation water, protects the mat conferring to the synthetic turf a high duration, and especially gives to the turf mechanical, physic and technologic features typical of the natural turf.

Such features are, for example: the elasticity of the ground for the user, the rebound of the ball, or other sports equipment, capacity of absorption of the hits when falling down, tensile and torque resistance to the force caused by the shoe, resistance against the compression and to the penetration of external bodies, as well as capacity of absorption and drainage of water in case of meteorological and environmental events.

For this reason the infill material of known type comprises a predetermined amount of sand that is necessary in order to have an effective drainage of the synthetic turf and a predetermined amount of rubber material, usually granular-shaped, which confers to the synthetic turf the necessary physical and mechanical properties above described, and, in particular, a high elasticity.

However, the rubber that is used in the above described infill material mainly consists of waste material, such as ground spent tyres, or in any case of a mixture of synthetic selected elastomers, and therefore it has a high content of toxic substances and potentially noxious both for the environment and for the people, such as heavy metals and volatile substances of various type.

Alternatively, granules of freshly prepared rubber are used in various chemical compositions, which are more expensive and in any case difficult to dispose of at the end of the life of the turf in addition to high costs.

The presence of such noxious substances in the rubber used as infill material represents, furthermore, an obstacle to dispose the spent synthetic turfs and to change the same with a new synthetic turf.

Furthermore, the elastomeric materials cannot retain much water and do accumulate heat, whereby in the hot seasons they create much more discomfort for the players than the natural turfs. In order to overcome this drawback solutions have been proposed that provide the use of predetermined organic material. However, the solutions that have been proposed up to now have the problem that the organic material indicated as infill material alternative to the elastomeric materials are subject to a quick degradation owing to the microbial attack to which they are inevitably exposed.

A solution to this technical problem is described, for example, in US2010/055461. This document provides, in particular, the use of an infill material for synthetic turfs which comprises organic particles, each of which coated with an antimicrobial agent. The antimicrobial agent is a chemical substance that is sprayed on the organic particles up to completely line them as a "coating", conferring them a round shape. In this way, the decomposition of the organic particles slows down.

However, the substance used as antimicrobial, in particular based on AEGIS Microbe Shield®, is a toxic material for the human beings and, therefore it is not indicated for use as infill of turfs for recreational or sports use.

Furthermore, the fragments, or particles, of material coated by the film of the used chemical substance are not able to interact with the surrounding environment, i.e. to take actively part in the processes that involve the infill and the turf, and to exercise their properties.

In addition to the above, the particles of organic material coated with such a substance have a high environmental impact. Therefore, when the synthetic turf has to be disposed of, or replaced, it is necessary to discharge the infill material in controlled dumps.

Another example of synthetic turf of known type is disclosed in WO2011/024066. In this case, the infill material comprises at least one layer consisting of a mixture of a predetermined amount of husks of cereal with at least one de-fibered wooden material that is resistant to microbial digestions. The use of cereal husks confers to the infill material a high elasticity owing to the properties of the husks and therefore allows to reduce, or to eliminate the use of rubber in the infill material.

SUMMARY OF THE INVENTION

It is therefore a feature of the present invention to provide an infill material for synthetic turfs, or for "hybrid" synthetic-natural turfs, which is highly performance and slowly biodegradable.

It is a particular feature of the present invention to provide an infill material for synthetic turfs or "hybrid" synthetic-natural turfs that is completely formed of natural vegetable material which is resistant to microbial attack.

It is also a feature of the present invention to provide an infill material for synthetic turfs and "hybrid" synthetic-natural turfs that can provide an effective drainage action.

These and other features are accomplished with one exemplary infill material, according to the invention, for synthetic turfs, or hybrid synthetic-natural turfs, whose main feature is to provide:

- a predetermined percentage by volume of a vegetable material consisting of rachis of cereal ear;
- a predetermined percentage by volume of a ligninic and/or resinous material of vegetable origin, i.e. having a high content of lignin and/or resin, in such a way to be highly resistant to the attack of microorganisms;

and where the rachis of cereal ear is not coated by a layer, or film, of material.

The presence of the ligninic and/or resinous material, allows to avoid the use of chemical substances for avoiding the degradation of the vegetable material allowing to provide an infill for synthetic turfs, or hybrid synthetic-natural, that is slowly biodegradable.

In particular, the material consisting of rachis of cereal ear, preferably of maize cob, produces an effective drainage action and allows therefore to reduce, or in particular to completely avoid, the use of sand in the infill material. This provides an infill material that is completely biodegradable.

Furthermore, the present invention allows the material consisting of rachis of cereal ear to fully exercise important properties. In particular, the material consisting rachis of cereal ear has a high porosity and is subjected to alternating cycles of expansion, or swelling, and of compression, or in any case of reducing in size. Therefore, the system is subject to a continuous action of auto-decompacting that allows to keep the infill tilled, i.e. with a high porosity and preserving substantially intact in the time the physical properties of the infill.

In addition, the material consisting of rachis of cereal ear, in particular maize cob, can absorb a high amount of humidity, for example when it rains and during irrigation operations, and to release then gradually the above described humidity, balancing the heat irradiated by the turf in the hotter seasons. For example, the maize cob has a water absorption capacity that is about 138%. Such properties avoid excessive heating of the infill material during the hotter seasons and, in particular in case of mixed synthetic and natural turfs, makes it possible to obtain optimal conditions for the growth of the plant species that are present in it.

Advantageously, the percentage by volume of said material consisting of rachis of cereal ear in said filling material is set between 5% and 90%.

Preferably, the vegetable material consisting of rachis of cereal ear is maize cob, i.e. rachis of maize. Such solution is particularly advantageous because the maize cob, i.e. the rachis of the maize, has a size that is normally higher than the size of the rachis of other cereals and has then better physical properties with respect to the other cereals.

In particular, the infill material can comprise:

- a lower layer, or stabilizing infill comprising said material consisting of rachis of cereal ear;
- an upper layer, or performance infill, comprising a mixture of:
  - a predetermined percentage by volume of said ligninic and/or resinous material of vegetable origin;
  - a predetermined percentage by volume of cereal husks.

Advantageously, the vegetable material consisting of rachis of cereals, in particular maize cob, has a granulometry set between 0.3 mm and 5.0 mm.

In an exemplary embodiment, the infill material provides a single layer comprising a mixture of a predetermined percentage by volume of said vegetable material consisting of rachis of cereal ear, of a predetermined percentage by volume of cereal husks and of a predetermined percentage by volume of said ligninic and/or resinous material of vegetable origin.

In an exemplary embodiment of the invention, the infill material, layered from below to above, consists of:

- a first layer comprising a predetermined percentage by volume of sand;
- a second layer comprising said material consisting of rachis of cereal ear;
- a third layer comprising a mixture of:
  - a predetermined percentage by volume of said vegetable material consisting of rachis of cereal ear;
  - a predetermined percentage by volume of cereal husks;
  - a predetermined percentage by volume of said ligninic and/or resinous material of vegetable origin.

In a further exemplary embodiment the infill material can also be a single layer comprising a mixture of:

- a predetermined percentage by volume of sand;
- a predetermined percentage by volume of said material consisting of rachis of cereal ear;
- a predetermined percentage by volume of cereal husks;
- a predetermined percentage by volume of said ligninic and/or resinous material of vegetable origin.

In particular, with the term "sand" it is to be understood a material having a mineralogical composition, for example siliceous sand, sand of pumice, sand of lapillus, zeolite, vermiculite, etc.

In particular, the ligninic and/or resinous material of vegetable origin can be mixed to a predetermined percentage by volume of a loose product obtained from a raw material based on ground cork.

Advantageously, the ligninic and/or resinous material of vegetable origin is selected from the group consisting of:

- a loose material based on ground coconut;
- olive stones;
- tegument of cracked pine-kernels;
- material obtained by de-fibring the cones, in particular pinecones of arboreous species of the *Pinus* species;
- common reed, or *Arundo donax*, ground into fragments, or particles of predetermined size;
- teguments of sunflower seeds;
- barley grain, in particular devitalized for avoiding germination;
- teguments of sunflower seeds;
- shells of dried fruit;
- fragments of banana plant parts;
- grape seeds and/or grape stalks of *Vitis vinifera;*
- Aloe fibres;
- or a combination thereof.

In case the vegetable ligninic and/or resinous material is a loose product obtained from a raw material based on ground coconut, said loose product preferably comprises the sole granular and fibrous part of the raw material based on ground coconut. More in detail, the sole granular and fibrous part is obtained undergoing the raw material based on ground coconut to a separation step, for example carried out by sieving, of the granular and fibrous part of the powder part in it present.

The infill material for synthetic turfs, according to the present invention, it is therefore completely biodegradable since it is exclusively made up of organic material. This avoids to dispose the infill material in controlled dump when the synthetic turf is abandoned and to avoid problems to the athletes who play the sports activities on the synthetic turf. Furthermore, the cob is highly hygroscopic and it is therefore able to absorb a high amount of humidity that then can release to the surrounding environment. Therefore, the presence of cob in the upper layer carries out a thermic regulation of the synthetic turf allowing to cool the surrounding air in the hot seasons and to absorb the humidity in the raining seasons, or in case of plenty irrigations.

In particular, the cereal husks, or chaff, is a by-product deriving from the work of the cereals and is formed by the whole of the bracts, or glumelle, which encircle the kernel.

Advantageously, the cereal husks is selected from the group consisting of:

rice husks;
husks of wheat;
husks of rye;
husks of oat;
husks of spelt;
or a combination thereof.

In a particularly advantageous exemplary embodiment, the cereal husks is rice husks.

In particular, the loose product obtained from a raw material based on ground coconut comprises the sole granular and fibrous part contained in the starting raw material based on coconut. For example, the granular and fibrous part can be obtained undergoing the starting raw material to a separation step of the granular and fibrous part from the powder part that is present in it.

Advantageously, the granular and fibrous part has the following granulometry:

among the 20% and 40% by weight set between 0.8 mm and 1.25 mm;
among the 15% and 35% by weight set between 1.25 mm and 1.60 mm;
among the 50% and 70% by weight larger than 1.6 mm.

According to another aspect of the invention, a structure of hybrid synthetic-natural turf comprises:

a mat equipped with a first face arranged on a surface to coat and with a second face opposite to the first face;
a plurality of blades of synthetic material connected to said mat, said plurality of blades of synthetic material protruding from said second face, in such a way to form a synthetic mat;
an infill material of said mat, said infill material as above described;
a living vegetable material arranged in said infill material, said living vegetable material arranged to form a natural turf that gets over in height said synthetic mat, said rooting arranged to steadily keep said granular infill material and to cause it to be integral to said blades of synthetic material.

According to a further aspect of the invention, a method for making a synthetic turf, or mixed synthetic-natural, comprises the steps of:

preparing a turf comprising a mat and a plurality of blades of synthetic material connected to said mat, said mat being equipped with a first face, arranged on a surface to coat, and with a second face opposite to the first face, said plurality of blades of synthetic material protruding from said second face;
distributing on said first face of said mat an infill material obtaining a synthetic turf, said infill material comprising:
a predetermined percentage by volume of a vegetable material consisting of rachis of cereal ear that is not coated;
a predetermined percentage by volume of a ligninic and/or resinous, material, i.e. having a high content of lignin and/or resin, and then highly resistant to the attack of microorganisms.

In a possible exemplary embodiment, the turf comprises:

a flexible not biodegradable support and arranged to act as barrier for the roots, in such a way that said roots does not cross at least in majority said flexible support;
a plurality of blades of synthetic material connected to said support, in order to form a synthetic mat at one side of said support;
an infill material arranged to be put between the blades, said infill material arranged to keep in a position substantially vertical said blades, even if leaving the blades protruding of a predetermined height, for example at least 10 mm.

In an exemplary embodiment, the blades of synthetic material can comprise smooth blades alternating to wavy, or curled blades.

Advantageously, the living vegetable material is selected from the group consisting of: monocotyledonous plant species, dicotyledonous plant species, propagable by seeds, or by a part of a plant.

In particular, the support can be provided with drainage holes having sizes such that they allow the drainage of the infill material, i.e. the outflow of the water below the support same, but at the same time to avoid the passage of the roots. This way, mat that can be rolled up is obtained that is able to simplify both the removal step, and the transport step, and the following installation step of the mat on the surface that has to receive it.

In an exemplary embodiment, the support may have a reticular structure, or having meshes of predetermined sizes.

BRIEF DESCRIPTION OF THE DRAWINGS

The invention will be now shown with the following description of an exemplary embodiment thereof, exemplifying but not limitative, with reference to the attached drawings in which.

DETAILED DESCRIPTION OF SOME EXEMPLARY EMBODIMENTS

Figure 1:
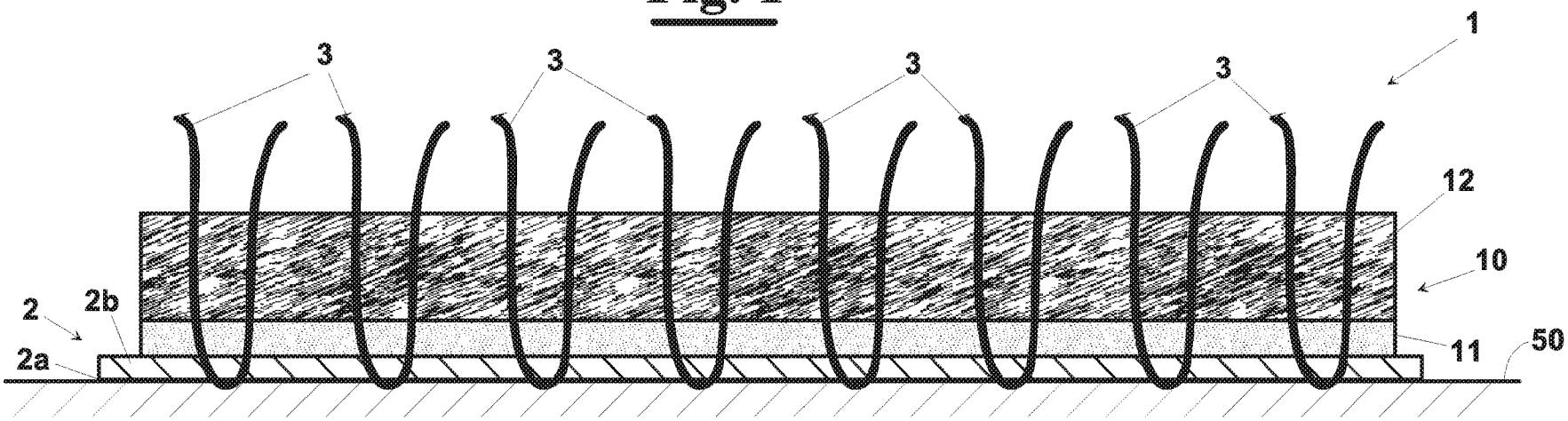
FIG. 1 diagrammatically shows a cross sectional view of a possible exemplary embodiment of a synthetic turf in which an infill material, according to the invention, is used.

With reference to FIG. 1, a synthetic turf 1, according to the invention, comprises a mat 2 provided with a face 2*a*, that, in use, is arranged adjacent to a surface 50 to be coated, and with a face 2*b* opposite to the face 2*a*. The turf 1 also comprises a plurality of blades 3 made of a synthetic material that are connected to the mat 2. Above the face 2*b* of the mat 2 an infill material 10 is also provided that is arranged among the blades 3 of synthetic material.

According to the invention, the infill material 10 comprises a predetermined percentage by volume of a vegetable material consisting of rachis of cereal ear. In a possible exemplary embodiment the cereal can be maize and therefore the vegetable material is cob. The infill material 10 also comprises a predetermined percentage by volume of a vegetable ligninic and/or resinous material i.e. having a high content of lignin and/or resin. The high content of lignin and/or resin makes these material, and therefore the infill material 10 of the whole turf, highly resistant to the attacks of microorganisms and allows, then to avoid the use of antibacterial chemical substances as provided for the turfs of prior art (see for example US2010/055461).

The presence of the ligninic and/or resinous material of vegetable origin allows in any case a slow and graduated decomposition of the material consisting of rachis of cereal ear. This is desired and appreciated, because the presence of a certain amount of microorganisms allows to reproduce a normal activity of a natural turf and allows to regenerate the turf owing to the hygienizing action that causes the elimination of the pathogenic agents and to keep nutritive substances. In order to compensate the slow degradation of the material consisting of rachis of cereal ear it is sufficient to periodically reintegrate the turf with new material. Unlike other solutions of the prior art as for example described in US2010/055461, therefore, it is essential that the material consisting of rachis of cereal ear is not coated by a film of substances that completely inhibit its natural biological activities.

As described in detail hereinafter, the infill material, according to the present invention, can be used both for synthetic turfs, i.e. comprising exclusively blades of synthetic material, and for "hybrid" turfs, i.e. comprising both blades of synthetic material and a living vegetable material.

In the exemplary embodiment of FIG. 1, the infill material 10 provides a lower layer 11, or stabilizing infill, comprising the material consisting of rachis of cereal ear, and an upper layer 12, or performance infill, comprising a mixture of said ligninic and/or resinous material of vegetable origin and rachis of cereal ear.

Both in the exemplary embodiment of FIG. 1 and in the exemplary embodiments described below, the ligninic and/or resinous material can be selected from the group consisting of: a loose material based on ground coconut, olive stones, teguments of the cracked pine-kernels, material obtained by de-fibring the cones, in particular cones of arboreous species of the *Pinus* type, common reed, or *Arundo donax*, ground into fragments, or particles of predetermined size, teguments of pistachio seeds, barley grain, in particular devitalized for avoiding germination, teguments of sunflower seeds, shells of dried fruits, fragments of banana plant parts, grape seeds and/or grape stalks of *Vitis vinifera*, Aloe fibres, or a combination thereof. In case the vegetable material is a loose product obtained from a raw material based on ground coconut, preferably it comprises the sole granular and fibrous part contained in the raw material based on the starting coconut. For example, the granular and fibrous part can be obtained undergoing the starting raw material to a separation step of the granular and fibrous part from the powder part that is present in it, as described in detail in WO2008125895. The ligninic and/or resinous material can be mixed with a predetermined percentage by volume of a raw material based on ground cork.

Figure 2:
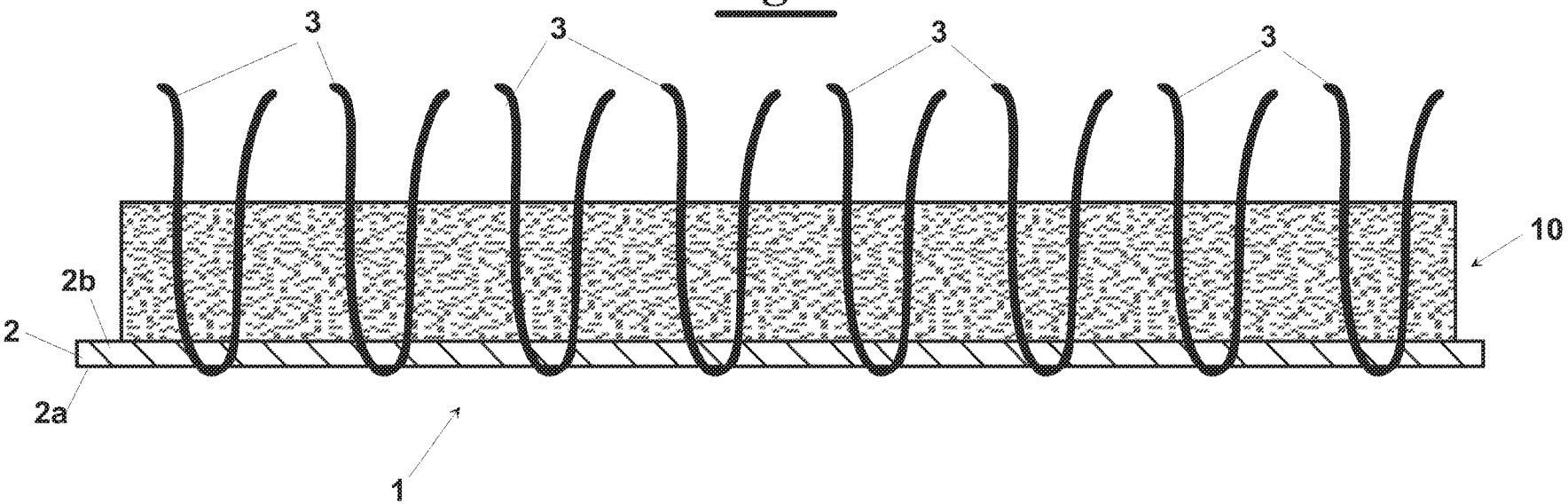
FIGS. 2 and 3 diagrammatically show a cross sectional view of two possible exemplary embodiments of the synthetic turf shown in FIG. 1.

In particular, the above described ligninic material in the presence of humidity form a three-dimensional reticular structure that keeps between its meshes the cereal husks, "trapping" it and so avoiding that it can raise from the turf and scatter in the surrounding environment. This makes it possible to fully exploit the physical properties of the cereal husks, in particular its high porosity and elasticity, and to avoid at the same time that it can hamper the action of the athletes during a sports event, in case it pile up on the surface. In the exemplary embodiment of FIG. 2, the infill material 10 provides a single layer comprising a mixture of a predetermined percentage by volume of vegetable material consisting of rachis of cereal ear, of a predetermined percentage by volume of husks of cereal and of a predetermined percentage by volume of ligninic and/or resinous material of vegetable origin.

The infill material 10 for synthetic turfs, or hybrid turfs, as described above, is completely, even if slowly, biodegradable because it consists exclusively of organic material. This allows to avoid the disposal of the infill material in controlled dump when the synthetic turf is abandoned.

In another exemplary embodiment, the layer 10 can comprise also a predetermined percentage by volume of sand mixed with the other materials.

Figure 3:
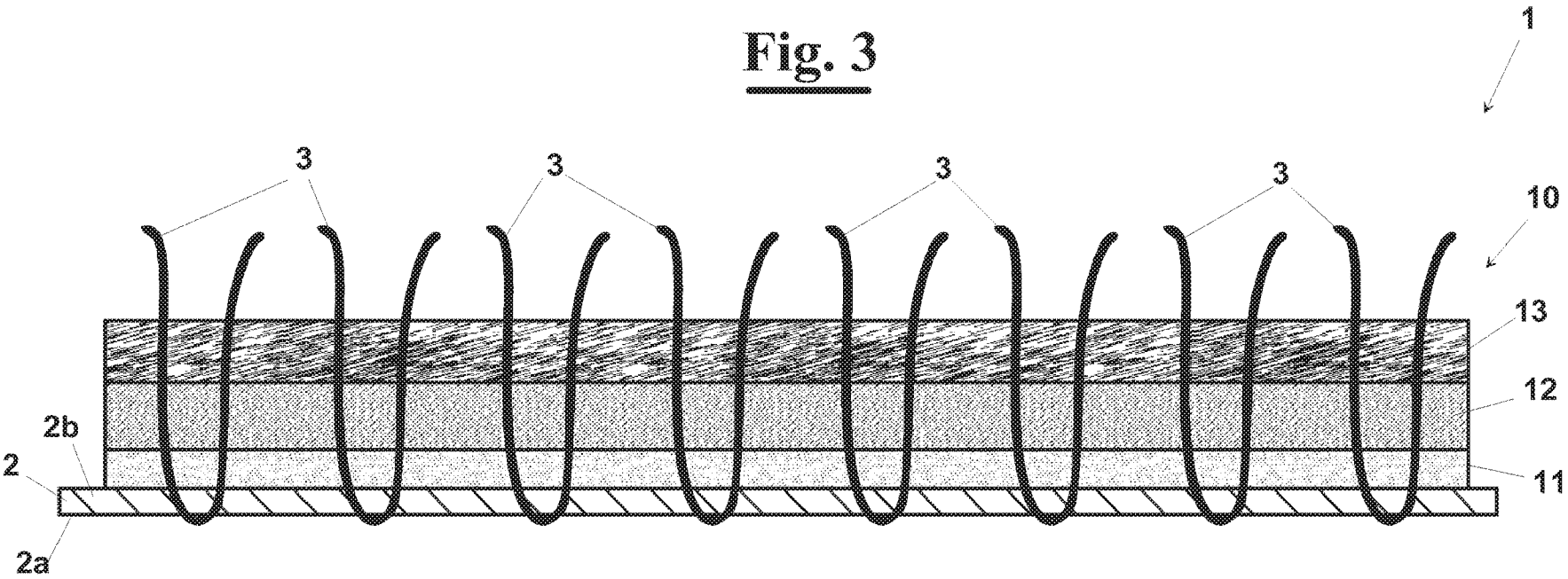

In the further exemplary embodiment, diagrammatically shown in FIG. 3, the infill material 10 provides a lower layer 11, an intermediate layer 12 and an upper layer 13. More in detail, the lower layer 11 can comprise a predetermined amount of sand, the intermediate layer 12 can comprise the material consisting of rachis of cereal ear, for example of cob, and the upper layer 13 can also be a mixture of ligninic and/or resinous material of cereal husks.

Figure 4:
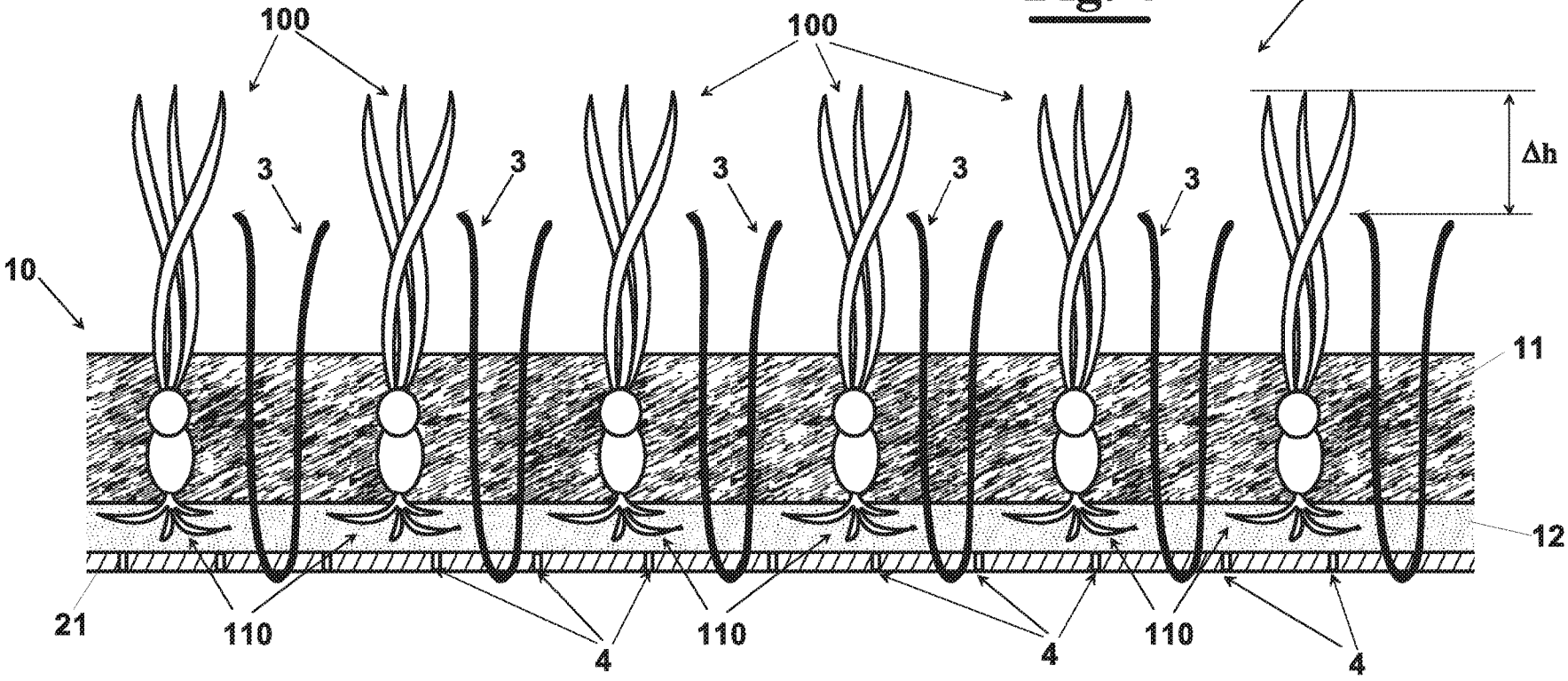
FIG. 4 diagrammatically shows a cross sectional view of a possible exemplary embodiment of a hybrid synthetic-natural turf in which an infill material, according to the invention, is used.
Figure 5:
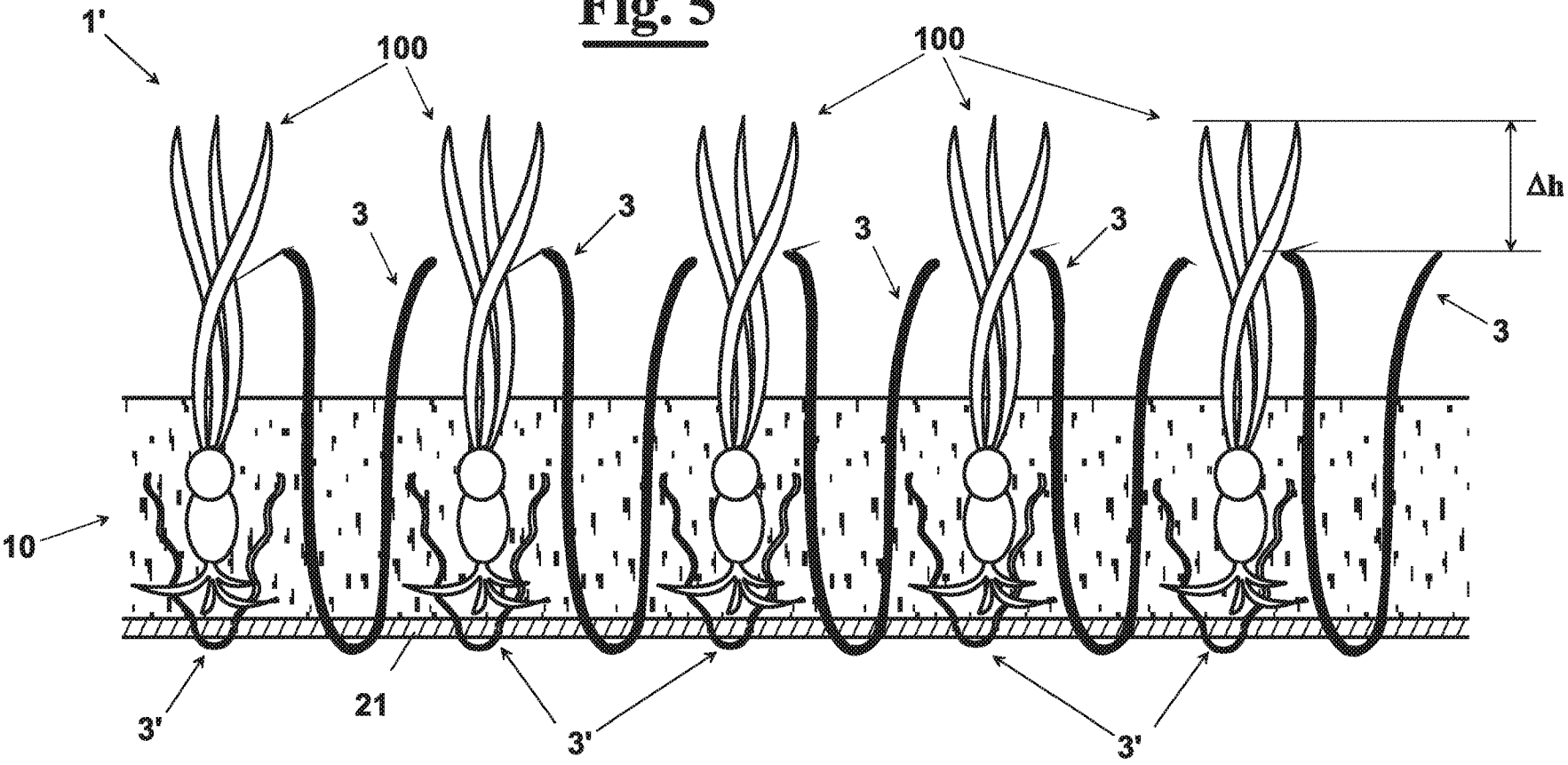
FIG. 5 diagrammatically shows a cross sectional view of an exemplary embodiment of the turf shown in FIG. 4.

In the FIGS. 4 and 5 hybrid turfs, are shown, i.e. comprising both leaves of the plant species 100, i.e. deriving from the growth of at least one vegetable species, and blades of synthetic material 3, 3', in which it is used infill material 10, according to the present invention. More in detail, in case of hybrid turfs 1' a flexible support 21 is provided. This can be made, for example, of a not biodegradable material, in such a way that it can work as a barrier for roots 110 of at least one living vegetable species 100 that roots in the infill material 10. Once a predetermined vegetative development is achieved, the vegetable species 100 form a natural turf that passes in height the synthetic mat consisting of the fibres of plastic material. As shown in FIGS. 4 and 5, the difference of height Dh between the leaves of plant species 100 and the blades of synthetic material 3 can be higher than about 10 cm.

The infill material 10 can have the same compositions of the synthetic turfs described with reference to FIGS. 1 to 5. For example, the infill material 10 can comprise a lower layer 11 and an upper layer 12 as described above, with reference to FIG. 1, (FIG. 4), or a single layer as described with reference to FIG. 2, (FIG. 5).

In this case, the above described property of the cob, as well as generally of the spine of other cereals, provides an auto-regulation of the heat of the turf obtaining ideal environmental conditions for the development of the living vegetable material 100.

The support 2 can provide drainage holes 4, having sizes such that it allows the outflow of the percolated obtained by the drainage action of the infill material, but at the same time to avoid the passage of the roots.

The foregoing description of an embodiment of the method and of the apparatus according to the invention will so fully reveal the invention according to the conceptual point of view so that other, by applying current knowledge, will be able to modify and/or adapt in various applications this specific embodiment without further research and without parting from the invention, and, accordingly, it is meant that such adaptations and modifications will have to be considered as equivalent to the exemplified specific embodiment. The means and the materials to realise the different functions described herein could have a different nature without, for this reason, departing from the field of the invention. It is to be understood that the phraseology or terminology that is employed herein is for the purpose of description and not of limitation.

The invention claimed is:

1. A synthetic or hybrid synthetic-natural turf for sports, recreational, or ornamental uses, comprising:

a mat having a first face arranged on a surface to be covered and a second face opposite the first face;

a plurality of blades of synthetic material connected to and extending from said second face, and forming a synthetic mat; and an infill material distributed on said second face;

wherein the infill material consists of a first layer consisting of a mixture of:

a predetermined percentage by volume of a vegetable material consisting of rachis of cereal ear that is not coated by a layer, or film, of material, and wherein said vegetable material consisting of rachis of cereal ear has a granulometry of between 0.3 mm and 5.0 mm;

a predetermined percentage by volume of a vegetable ligninic and/or resinous material containing lignin and/or resin, being resistant to attack by microorganisms; and a predetermined percentage by volume of a loose final product from raw material based on ground cork; and a second layer positioned below the first layer and consisting of a vegetable material consisting of rachis of cereal ear that is not coated by a layer, or film, of material.

2. The turf according to claim 1, wherein said percentage by volume of said vegetable material consisting of rachis of cereal ear in said infill material is between 5% and 90%.

3. The turf according to claim 1, wherein said ligninic and/or resinous material of vegetable origin is selected from the group consisting of:

loose material based on ground coconut;

olive stones;

tegument of cracked pine-kernels;

material obtained by defibering *Pinus* cones;

common reed, or *Arundo donax*, ground into fragments, or particles of predetermined size;

teguments of pistachio seeds;

barley grain devitalized for avoiding germination;

teguments of sunflower seeds;

shells of dried fruits;

fragments of banana plant parts;

grape seeds and/or stalks of Vitus *vinifera;*

Aloe fibers; and combinations thereof.

4. The turf according to claim 1, wherein said rachis of cereal ear is maize cob.

5. The turf according to claim 1, further comprising a living vegetable material arranged to form a natural turf in the infill material comprising a plurality of natural blades that are longer than the plurality of blades of synthetic material, the natural turf having rooting arranged to secure the infill material, and to cause the natural turf to be integral to said plurality of blades of synthetic material.

6. A synthetic or hybrid synthetic-natural turf for sports, recreational, or ornamental uses, comprising:

a mat having a first face arranged on a surface to be covered and a second face opposite the first face;

a plurality of blades of synthetic material connected to and extending from said second face, and forming a synthetic mat; and an infill material distributed on said second face;

wherein the infill material consists of:

a first layer consisting of a mixture of:

a predetermined percentage by volume of a vegetable material consisting of rachis of cereal ear that is not coated by a layer, or film, of material, and wherein said vegetable material consisting of rachis of cereal ear has a granulometry of between 0.3 mm and 5.0 mm;

a predetermined percentage by volume of a vegetable ligninic and/or resinous material containing lignin and/or resin, being resistant to attack by microorganisms;

a predetermined percentage by volume of a loose final product from raw material based on ground cork; and a predetermined percentage by volume of cereal husks, and a second layer positioned below the first layer;

wherein the second layer consists of a vegetable material consisting of rachis of cereal ear that is not coated by a layer, or film, of material.

7. The turf according to claim 6, wherein said cereal husks are selected from the group consisting of:

rice husks;

husks of wheat;

husks of rye;

husks of oat;

husks of spelt; and combinations thereof.

8. A synthetic or hybrid synthetic-natural turf for sports, recreational, or ornamental uses, comprising:

a mat having a first face arranged on a surface to be covered and a second face opposite the first face;

a plurality of blades of synthetic material connected to and extending from said second face, and forming a synthetic mat; and an infill material distributed on said second face;

wherein the infill material consists of a first layer consisting of a mixture of:

a predetermined percentage by volume of a vegetable material consisting of rachis of cereal ear that is not coated by a layer, or film, of material, and wherein said vegetable material consisting of rachis of cereal ear has a granulometry of between 0.3 mm and 5.0 mm;

a predetermined percentage by volume of a vegetable ligninic and/or resinous material containing lignin and/or resin, being resistant to attack by microorganisms;

a predetermined percentage by volume of a loose final product from raw material based on ground cork; and a predetermined percentage by volume of sand; and a second layer positioned below the first layer, and consisting of a vegetable material consisting of rachis of cereal ear that is not coated by a layer, or film, of material.

9. A method of making a synthetic or hybrid synthetic-natural turf, comprising:

preparing a turf comprising a mat and a plurality of blades of synthetic material connected to said mat, said mat being equipped with a first face, which is adjacent to a surface to be covered, and with a second face opposite to the first face, said plurality of blades of synthetic material protruding from said second face; and distributing on said second face of said mat an infill material obtaining a synthetic or hybrid synthetic-natural turf, said infill material consisting of a first layer which is a mixture of:

a predetermined percentage by volume of a vegetable material consisting of rachis of cereal ear, said rachis of cereal ear that is not coated by a layer, or film, of material, and wherein said vegetable material consisting of rachis of cereals has a granulometry of between 0.3 mm and 5.0 mm;

a predetermined percentage by volume of a ligninic and/or resinous material containing lignin and/or resin, the ligninic and/or resinous material being resistant to attack by microorganisms; and a predetermined percentage by volume of a loose final product from raw material based on ground cork; and a second layer positioned below the first layer, and consisting of a vegetable material consisting of rachis of cereal ear that is not coated by a layer, or film, of material.

* * * * *